US006044890A

United States Patent [19]

Renée

[11] Patent Number: 6,044,890

[45] Date of Patent: Apr. 4, 2000

[54] WAND ADAPTER FOR VENETIAN BLINDS

[76] Inventor: William C. Renée, 35109 #38 Highway 79, Warner Springs, Calif. 92086

[21] Appl. No.: 09/281,010

[22] Filed: Mar. 30, 1999

[51] Int. Cl.[7] ..... E06B 9/38

[52] U.S. Cl. ..... 160/177 R; 160/178.1 R

[58] Field of Search ..... 160/176.1 R, 176.1 V, 160/177 R, 177 V, 178.1 R, 178.1 V, 168.1 R, 168.1 V, 900

[56] References Cited

U.S. PATENT DOCUMENTS

| | | | |
|---|---|---|---|
| 4,507,831 | 4/1985 | McClure | 160/178.1 R X |
| 4,607,974 | 8/1986 | Brothers et al. | 160/177 R X |
| 4,759,398 | 7/1988 | Renée | 160/178.1 |
| 4,875,516 | 10/1989 | Marocco | 160/177 R X |
| 5,002,113 | 3/1991 | Georgopoulos | 160/176.1 R |
| 5,092,387 | 3/1992 | King et al. | 160/176.1 R |
| 5,186,229 | 2/1993 | Hsu | 160/177 R |
| 5,396,945 | 3/1995 | Meyer | 160/177 R |
| 5,476,132 | 12/1995 | Jacobson | 160/178.1 V X |
| 5,553,649 | 9/1996 | Chisaka et al. | 160/176.1 R X |
| 5,647,422 | 7/1997 | Weng | 160/176.1 V |
| 5,850,863 | 12/1998 | Huang | 160/176.1 R X |

*Primary Examiner*—David M. Purol
*Attorney, Agent, or Firm*—Calif Tervo

[57] ABSTRACT

A wand (10) for operating the rotatable drive (93) of a venetian blind (90); rotatable drive (93) including a drive post (95) having a horizontal bore (97) therethrough or a drive hook (93). Wand (10) includes an elongate handle (20) having a longitudinal axis (28) and including a connector (30) including a clevis (40) adapted for connection to rotatable drive (93). Clevis (40) includes a pair of posts (42) having a bore (46) therethrough, posts (42) spaced for receiving therebetween drive post (95), and a pin (50) for disposition in bore (46). A hook drive (60) is pivotally attached to pin (50) in clevis (40) and includes a bore (67) therethrough adapted to receive and rotate hook (94). Handle (10) includes axially extending external threads (21) and a hand-operated nut (23) interacting with threads (21) for rotating wand (10). Pin (50) includes one or more of protuberances (55) and a hollow (56). Protuberances (55) are disposed in the space between posts (42) when pin (50) is disposed in post bore (46).

19 Claims, 2 Drawing Sheets

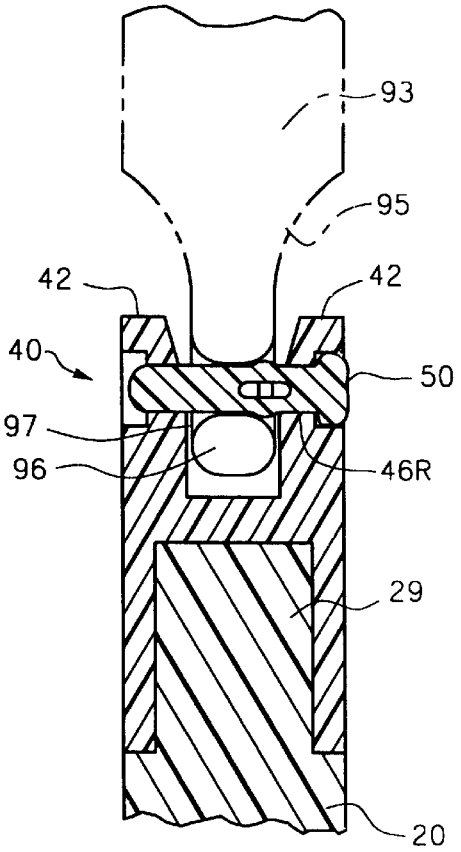
FIG. 5
FIG. 6
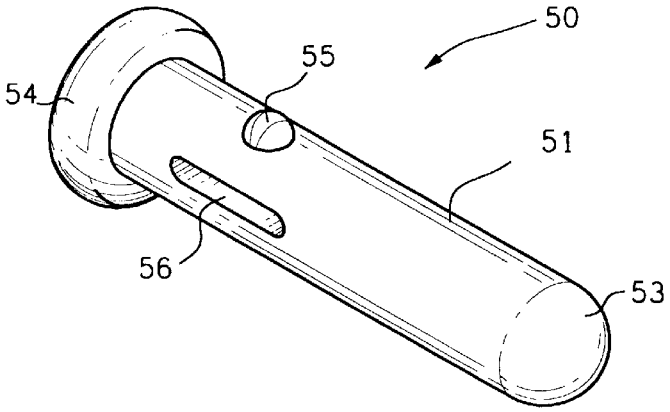
FIG. 7
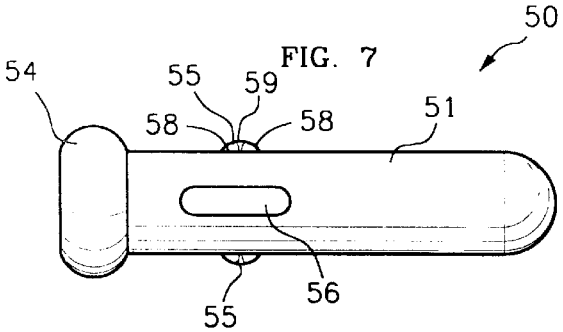
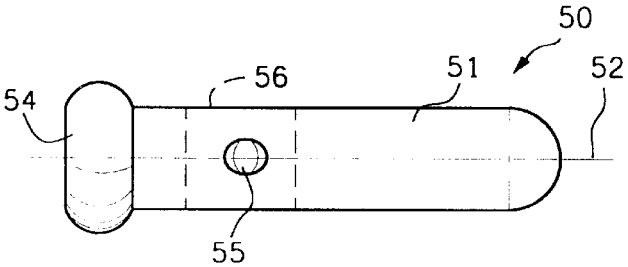
FIG. 8
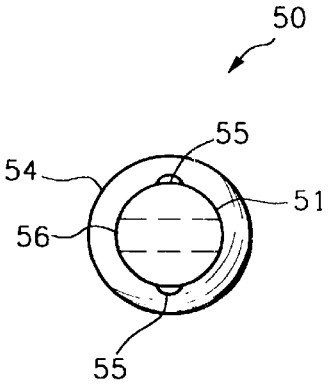
FIG. 9
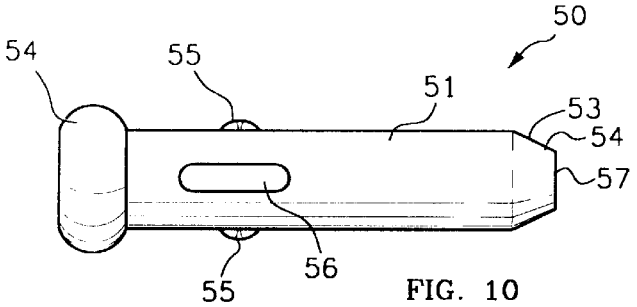
FIG. 10

WAND ADAPTER FOR VENETIAN BLINDS

FIELD OF THE INVENTION

This invention relates to wands for operating the rotatable drive of a venetian blind and more specifically involves an improved wand connector for attachment to different types of rotatable drives of venetian blinds.

BACKGROUND OF THE INVENTION

Many small-slat venetian blinds, often called mini-blinds, are in use today in windows of homes and offices. To tilt the slats of such blinds, it is common to rotate a vertical elongate wand which is connected to a rotatable drive on upper portion of the blind. the rotatable drive on conventional blinds is typically a post having a horizontal bore therethrough or a hook.

In my previous patent, U.S. Pat. No. 4,759,398, I disclose an improved wand handle that includes axially extending external threads. A hand-operated nut mounted on the wand handle includes internal threads that interact with the wand handle threads for rotating the wand in response to vertical movement of the nut. The improved wand handle greatly facilitates rotation of the wand, both in speed and ease of rotation.

Wands must be replaced periodically and high speed wands of the type described above are often used to replace conventional wands. Conventional replacement wands are sold having a drive connector for the specific type of connector on the blind. This is problematic as the buyer often has not paid any attention to this feature. Therefore, there has been a need for a replacement wand having a drive connector easily adaptable to both types of drive. Also, although a replacement wand is more easily connected to a drive hook, the connection is not as secure as with a drive post and the elements may disengage during use. This is particularly true with the high speed wands due to the increased wand movement during use. Therefore, there has been a need for an improved wand connection for drive hooks and particularly an improved connection for high speed wands.

SUMMARY OF THE INVENTION

This invention is a wand for operating the rotatable drive of a venetian blind, the rotatable drive including a drive post having a horizontal bore therethrough or a drive hook. The wand includes an elongate handle having a longitudinal axis and including an upper end including a connector including a clevis adapted for connection to a rotatable drive of a venetian blind. The clevis includes a pair of posts spaced for receiving therebetween a drive post of a venetian blind, the clevis posts having a horizontal bore therethrough, and a pin for disposition in the bore of the clevis posts. A hook drive includes a bottom end including a bore therethrough pivotally attached to the pin in the clevis, and a top end including a bore therethrough adapted to receive a rotatable hook drive of a venetian blind for rotatably driving the hook.

In an exemplary embodiment of the invention, the handle includes axially extending external threads and an operator or nut mounted on the handle includes internal threads interacting with the handle threads for rotating the wand in response to movement of the nut in the direction of the longitudinal axis of the handle.

In an exemplary embodiment, the pin includes an insertion portion for insertion in the post bore. The insertion portion includes retaining means including a plurality of protuberances about circumference of the insertion portion defining a diameter greater than the diameter of the post bore and a hollow within the pin central of the protuberances so as to resiliently outwardly bias the protuberances. Preferably, the protuberances are disposed in the space between the posts when the pin is disposed in the post bore.

Other features and many attendant advantages of the invention will become more apparent upon a reading of the following detailed description together with the drawings in which like reference numerals refer to like parts throughout.

BRIEF DESCRIPTION OF THE DRAWINGS

FIG. 5 is vertical cross sectional view of the wand connector shown attached to a drive post (in phantom) of a venetian blind.

FIG. 6 is an enlarged perspective view of the pin of the wand connector.

FIG. 7 is a front side view of the pin of FIG. 6,

FIG. 8 is a top plan view of the pin of FIG. 7.

FIG. 9 is a left end view of the pin of FIG. 7.

FIG. 10 is a partial side view of an alternate embodiment of the pin.

DETAILED DESCRIPTION OF THE INVENTION

Figure 1:
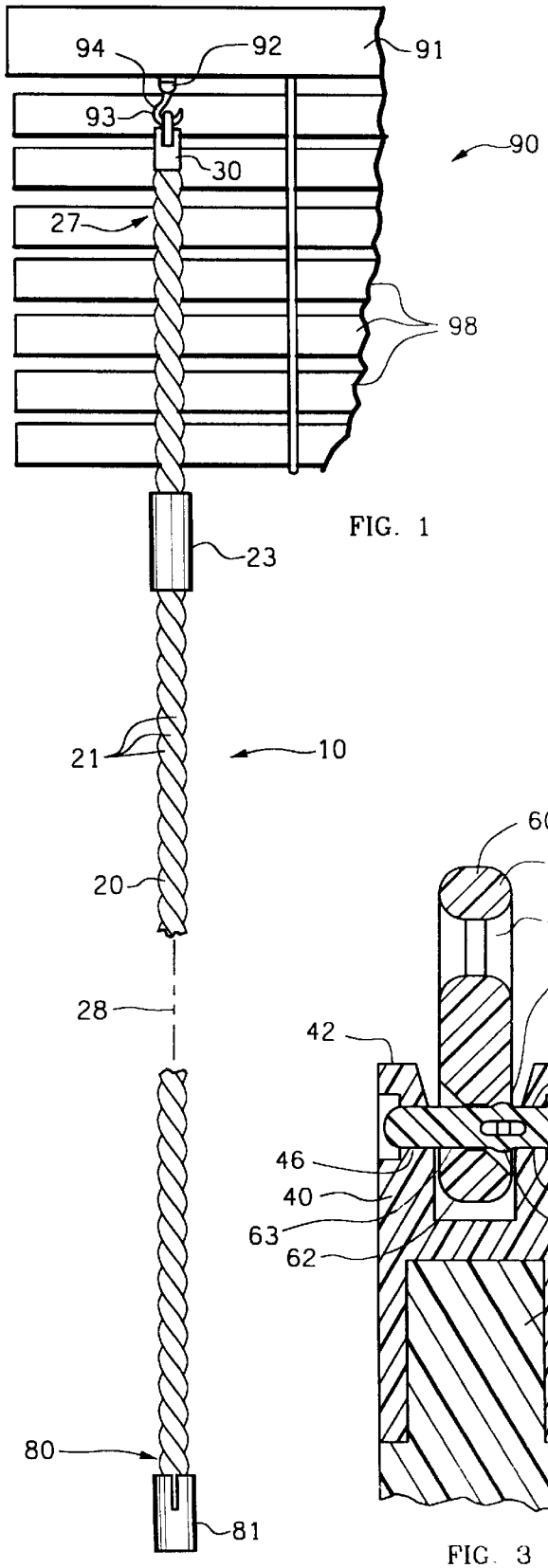
FIG. 1 is a fragmentary, vertical, front elevation view of a venetian blind combined with a wand constructed in accordance with the invention.

With reference now to the drawing, and particularly to FIG. 1 thereof, there is shown a fragmentary, vertical, front elevation view of a venetian blind 90 combined with a wand 10 constructed in accordance with the invention.

Venetian blind 90 includes an upper portion or housing 91 that is typically mounted on the wall above a window and includes mechanism for maneuvering slats 98 including a downwardly extending portion 92 terminating in a rotatable drive 93, such as drive hook 94, shown. Rotation of drive 93 rotates slats 98.

Wand 10 generally includes an elongate handle 20 having a vertical longitudinal axis 28 and including an upper end 29 including a connector 30 for attachment to drive 93 such that rotation of handle 20 about its longitudinal axis 28 rotates drive 93. The components of the invention can be made of any suitable materials, such as plastic or metals.

In the present Specification and Claims, the term "venetian blind" refers to any tilt-slat shade that is operated by rotation of a wand 10 about its longitudinal axis 28. The terms include, but are not limited to, conventional venetian blinds, miniature-size blinds (mini blinds), and louver blinds. Also, in the present Specification and Claims, the terms of direction, e.g. "upward" and "downward" are terms of convenience to indicate relative positioning of elements and not to indicate absolute direction, For example, wand 10 may be horizontal, in which context the term "upper end" has no meaning unless "upper" is relative.

Wand 10, shown, includes a speed handle 20 of the type described in my prior U.S. Pat. No. 4,759,398. Handle 20 has axially extending external threads 21. External threads 21, shown, may be made by twisting an extruded wand of non-circular cross-section, e.g. hexagonal, so that the intersections of the sides form a helix. A hand-propelled, push-pull operator or nut 23 mounted on handle 20 includes internal protrusions or threads interacting with handle threads 21 for rotating wand 10 in response to movement of nut 23 in the direction of the longitudinal axis 28 of handle 20. Hand nut 23 rotates about the longitudinal axis with a resilient drag force so as to maintain its position on the handle 20 when it is not being moved by a person. A bearing element 81 is attached to lower end 80 of handle 20 so as to rotate freely about the longitudinal axis. Bearing element 81 can be held steady with one hand while nut 23 is operated with the other hand to move slats 98.

Figure 2:
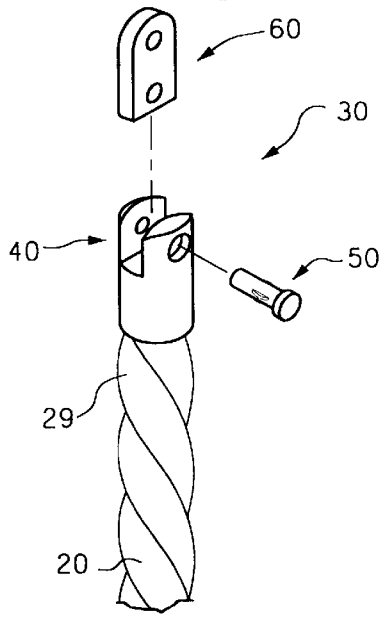
FIG. 2 is a fragmentary enlarged exploded perspective of a preferred embodiment of the wand connector of FIG. 1.
Figure 3:
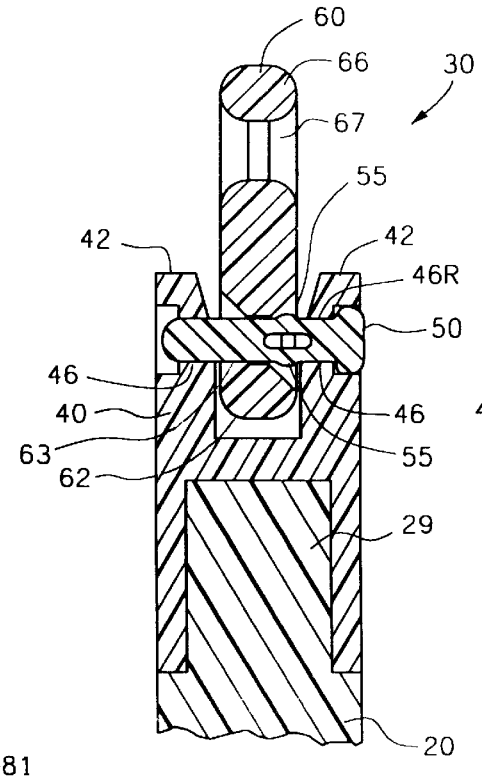
FIG. 3 is an enlarged vertical cross sectional view of the wand connector of FIG. 2.
Figure 4:
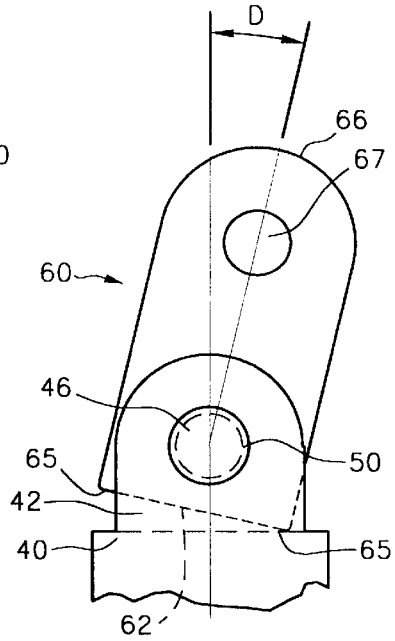
FIG. 4 is a fragmentary side view of the connector of FIG. 3.

Turning now to FIGS. 2–4, there is shown more detailed aspects of connector 30. FIG. 2 is a fragmentary enlarged exploded perspective of a preferred embodiment of wand connector 30 of FIG. 1. FIG. 3 is an enlarged vertical cross sectional view of connector 30 of FIG. 2. FIG. 4 is a fragmentary side view of connector 30 of FIG. 3.

Connector 30 generally includes a clevis 40, a fastener, such as pin 50, and a hook drive 60. Clevis 40 is attached to the upper end 29 of handle 20 by any suitable means, such as by pinning, welding, or gluing. Clevis 40 includes a pair of spaced posts 42 having a horizontal bore 46 therethrough and pin 50 for disposition in post bore 46. Pin 50 includes retaining means, such as one or more protuberances 55, for selectively retaining pin 50 in bore 46. In longitudinal cross-section, each protuberance 55 includes a slanted lead portion 58 on its front and back and a radiused apex 59. These features contribute to the ease of use of pin 50. Hook drive 60 has a bottom end 62 for insertion in the space between posts 42 including a bore 63 therethrough pivotally attached to pin 50 in clevis 40, and a top end 66 including a bore 67 therethrough adapted to receive the rotatable drive hook 94 of a blind 90 for rotatably driving drive hook 94.

As best seen in FIG. 4, bottom end 62 of hook drive 60 includes stabilizing means, such as stops, such as corners 65, interacting with upper end 29 of wand, such as with the bottom of the area between posts 42, for restricting pivotal movement of hook drive 60 on pin 50 such that hook drive 60 cannot rotate 90° or more. Preferably, rotation of hook drive is limited in pivotal movement to within an angle "D" of 0°–20° to the longitudinal axis 28 of handle 20. With an angle D greater than 20°, it has been found that, upon transmission of the rotation of handle 20 to drive 93, upper end 29 of handle 20 moves radially to the side such that longitudinal axis 28 of handle 20 is not aligned with the axis of rotation of drive 93. Transmission of torque thus becomes more difficult. However, some pivoting of hook drive 60 on pin 50 is desirable to accommodate some play in drive 93 and facilitates attachment to hook 94. As best seen in FIG. 3, the entry to top end bore 67 of hook drive 60 is greatly tapered to facilitate attachment to hook 94.

FIG. 5 is vertical cross sectional view of wand connector 30 shown attached to a drive post 95 (in phantom) of venetian blind 90. Hook drive 60 has been unattached from clevis 40 by removing pin 50 from bore 46. Drive post 95 has a lower end 96 including a horizontal through bore 97. Clevis posts 42 straddle lower end 96 of drive post 95 and pin 50 is inserted through bores 46, 67 to retain wand 10 to drive post 95.

It is important that connector 30 be easily converted between the configuration shown in FIG. 3 for attachment to drive hook 94 and the configuration of FIG. 5 for attachment to drive post 95, and that it be easily attached to drive post 95. To accomplish this, pin 50 should be easy to remove and replace.

FIGS. 6–9 depict a preferred embodiment of pin 50. FIG. 6 is an enlarged perspective view, FIG. 7 is a front side view, FIG. 8 is a top plan view, and FIG. 9 is a left end view.

Pin 50 includes an insertion portion, such as elongate shaft 51, for insertion into post bores 46. Shaft 51 has a longitudinal axis 52 and includes an insertion end 53 that is rounded to aid in entry of bores 46, 63, 97. Enlarged end cap 54 stops insertion of pin 50. Retaining means, includes a resilient detent, such as a plurality of protuberances 55, on the circumference of shaft 51 defining a diameter greater than the diameter of receiving post bore 46R and a hollow within said pin or an elongate bore 56 central of protuberances 55 so as to resiliently outwardly bias protuberances 55. Preferably, protuberances 55 are disposed in the space between posts 42 when pin 50 is disposed in post bore 46.

In this manner, a retention pin 50 of one-piece construction is provided where the retaining portion, e.g. detent 55, only needs be forced through one bore, that is through receiving bore 46R of one clevis post 42.

FIG. 10 is a partial side view of an alternate embodiment of the pin 50 in which insertion end 53 includes a chamfered portion 54 to aid in insertion and includes an end face 57 adapted, such as by being dimpled or flat, as shown, for receiving a removal instrument to aid in removal. To remove pin 50 from the fastening position, flat end face 57 can be pushed on by most any pointed instrument, such as a pen or pin or the like.

Having described the invention, it can be seen that it provides a very convenient device for connecting a wand 10, particularly a speed wand, to blinds 90.

Although a particular embodiment of the invention has been illustrated and described, various changes may be made in the form, composition, construction, and arrangement of the parts without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. A wand for operating the rotatable drive hook of a venetian blind; said wand comprising:

an elongate handle having a longitudinal axis and including an upper end including a connector comprising:

a clevis comprising:

a pair of spaced posts having a horizontal bore therethrough; and a fastener for disposition in said post bore including retaining means for selectively retaining said fastener in said bore; and a hook drive comprising:

a bottom end including a bore therethrough pivotally attached to said fastener in said clevis; and a top end including a bore therethrough adapted to receive the rotatable drive hook of a venetian blind for rotatably driving the hook; wherein said fastener includes a pin; and said fastener retaining means includes:

a resilient detent defining a diameter of said pin larger than said post bore; said detent disposed in the space between said posts when said pin is disposed in said post bore.

2. The wand of claim 1 wherein said bottom end of said hook drive includes:

stabilizing means interacting with said upper end of said wand for restricting pivotal movement of said hook drive on said fastener to less than 90° from the longitudinal axis of said handle.

3. The wand of claim 2 wherein said stabilizing means includes:

stops that contact said upper end of said wand.

4. The wand of claim 1 wherein:

said fastener includes a pin; and said fastener retaining means includes:

a resilient detent defining a diameter of said pin larger than a said post bore; said detent disposed in the space between said posts when said pin is disposed in said post bore.

5. The wand of claim 1 wherein said handle includes axially extending external threads; and said wand further includes:

a nut mounted on said handle including internal threads interacting with said handle threads for rotating said wand in response to movement of said nut in the direction of the longitudinal axis of said handle.

6. The wand of claim 5, wherein said bottom end of said hook drive includes:

stabilizing means interacting with said upper end of said wand for restricting pivotal movement of said hook drive on said fastener to less than 90° from the longitudinal axis of said handle.

7. The wand of claim 6 wherein said stabilizing means includes:

stops that contact said upper end of said wand.

8. A wand for operating the rotatable drive hook of a venetian blind; said wand comprising:

an elongate handle having a longitudinal axis and including an upper end including a connector comprising:

a clevis comprising:

a pair of spaced posts having a horizontal bore therethrough; and a fastener for disposition in said post bore including retaining means for selectively retaining said fastener in said bore; and a hook drive comprising:

a bottom end including a bore therethrough pivotally attached to said fastener in said clevis; and a top end including a bore therethrough adapted to receive the rotatable drive hook of a venetian blind for rotatably driving the hook; wherein said fastener includes a pin including:

an insertion portion for insertion in said post bore; said insertion portion including said retaining means; said retaining means including:

a surface protuberance defining a diameter greater than the diameter of said post bore and a hollow within said pin central of said protuberance such as to resiliently outwardly bias said protuberance; said protuberance disposed in the space between said posts when said pin is disposed in said post bore.

9. The wand of claim 8 wherein said bottom end of said hook drive includes:

stabilizing means interacting with said upper end of said wand for restricting pivotal movement of said hook drive on said fastener to less than 90° from the longitudinal axis of said handle.

10. The wand of claim 9 wherein said stabilizing means includes:

stops that contact said upper end of said wand.

11. The wand of claim 8 wherein said handle includes axially extending external threads; and said wand further includes:

a nut mounted on said handle including internal threads interacting with said handle threads for rotating said wand in response to movement of said nut in the direction of the longitudinal axis of said handle.

12. The wand of claim 11 wherein said bottom end of said hook drive includes:

stabilizing means interacting with said upper end of said wand for restricting pivotal movement of said hook drive on said fastener to less than 90° from the longitudinal axis of said handle.

13. The wand of claim 12 wherein said stabilizing means includes:

stops that contact said upper end of said wand.

14. A wand for operating the rotatable drive hook of a venetian blind; said wand comprising:

an elongate handle having a longitudinal axis and including an upper end including a connector comprising:

a clevis comprising:

a pair of spaced posts having a horizontal bore therethrough; and a fastener for disposition in said post bore including retaining means for selectively retaining said fastener in said bore; and a hook drive comprising:

a bottom end including a bore therethrough pivotally attached to said fastener in said clevis; and a top end including a bore therethrough adapted to receive the rotatable drive hook of a venetian blind for rotatably driving the hook; wherein said fastener includes a pin including:

an insertion portion for insertion in said post bore; said insertion portion including said retaining means; said retaining means including:

a plurality of protuberances about circumference of said insertion portion defining a diameter greater than the diameter of said post bore and a hollow within said pin central of said protuberances so as to resiliently outwardly bias said protuberances; said protuberances disposed in the space between said posts when said pin is disposed in said post bore.

15. The wand of claim 14 wherein said bottom end of said hook drive includes:

stabilizing means interacting with said upper end of said wand for restricting pivotal movement of said hook drive on said fastener to less than 90° from the longitudinal axis of said handle.

16. The wand of claim 15 wherein said stabilizing means includes:

stops that contact said upper end of said wand.

17. The wand of claim 14 wherein said handle includes axially extending external threads; and said wand further includes:

a nut mounted on said handle including internal threads interacting with said handle threads for rotating said wand in response to movement of said nut in the direction of the longitudinal axis of said handle.

18. The wand of claim 17 wherein said bottom end of said hook drive includes:

stabilizing means interacting with said upper end of said wand for restricting pivotal movement of said hook drive on said fastener to less than 90° from the longitudinal axis of said handle.

19. The wand of claim 18 wherein said stabilizing means includes: stops that contact said upper end of said wand.

* * * * *